US011532288B2

(12) United States Patent
Shigeta

(10) Patent No.: US 11,532,288 B2
(45) Date of Patent: Dec. 20, 2022

(54) SOURCE DRIVER AND DISPLAY APPARATUS

(71) Applicant: LAPIS Technology Co., Ltd., Yokohama (JP)

(72) Inventor: Kenichi Shigeta, Yokohama (JP)

(73) Assignee: LAPIS TECHNOLOGY CO., LTD., Yokohama (JP)

( * ) Notice: Subject to any disclaimer, the term of this patent is extended or adjusted under 35 U.S.C. 154(b) by 0 days.

(21) Appl. No.: 17/556,500

(22) Filed: Dec. 20, 2021

(65) Prior Publication Data

US 2022/0199050 A1 Jun. 23, 2022

(30) Foreign Application Priority Data

Dec. 22, 2020 (JP) ..... JP2020-212025

(51) Int. Cl.
*G09G 3/36* (2006.01)

(52) U.S. Cl.
CPC ..... *G09G 3/3688* (2013.01); *G09G 3/3648* (2013.01); *G09G 3/3677* (2013.01); *G09G 2310/08* (2013.01); *G09G 2320/045* (2013.01)

(58) Field of Classification Search
CPC ..... G09G 2300/0426; G09G 2310/08; G09G 2320/045
See application file for complete search history.

(56) References Cited

U.S. PATENT DOCUMENTS

2002/0021483 A1* 2/2002 Katase ..... G09G 3/344 359/267
2002/0190974 A1* 12/2002 Morita ..... G09G 3/3666 345/208
2020/0267341 A1* 8/2020 Baba ..... H04N 5/369
2021/0152758 A1* 5/2021 Muraoka ..... H04N 5/378

FOREIGN PATENT DOCUMENTS

JP 2009-015178 A 1/2009

* cited by examiner

*Primary Examiner* — Van N Chow
(74) *Attorney, Agent, or Firm* — Rabin & Berdo, P.C.

(57) ABSTRACT

A source driver includes a latch unit sequentially retrieving a video data signal for each data row corresponding to each of a first to n th horizontal scanning lines of the display panel, an overdrive arithmetic circuit calculating an overdrive value of the drive voltage applied to the pixel portions on an N th line based on a comparison result of comparing the data row corresponding to the N th line among the first to n th horizontal scanning lines and the data row corresponding to an (N−1) th line and a distance to the N th line from the source driver, and a voltage output unit generating the drive voltage applied to the pixel portions on the N th line based on the data row corresponding to the N th line and the overdrive value to output to the source line.

6 Claims, 8 Drawing Sheets

| | (N-1) LINE DATA | | | (N) LINE DATA | | | WRITE DATA | | | |
|---|---|---|---|---|---|---|---|---|---|---|
| | D5 | D6 | D7 | D5 | D6 | D7 | D5 | D6 | D7 | |
| Case 1 | X | 0 | 0 | X | 1 | 1 | X | 1 | 1 | |
| | X | 0 | 0 | X | 1 | 0 | X | 1 | 1 | CHANGE D7 |
| | X | 0 | 0 | X | 0 | 1 | X | 1 | 0 | CHANGE D7/6 |
| | X | 0 | 0 | X | 0 | 0 | X | 0 | 0 | |
| Case 2 | X | 0 | 1 | X | 1 | 1 | X | 1 | 1 | |
| | X | 0 | 1 | X | 1 | 0 | X | 1 | 1 | CHANGE D7 |
| | X | 0 | 1 | X | 0 | 1 | X | 0 | 1 | |
| | X | 0 | 1 | X | 0 | 0 | X | 0 | 0 | |
| Case 3 | X | 1 | 0 | X | 1 | 1 | X | 1 | 1 | |
| | X | 1 | 0 | X | 1 | 0 | X | 1 | 0 | |
| | X | 1 | 0 | X | 0 | 1 | X | 0 | 0 | CHANGE D7/6 |
| | X | 1 | 0 | X | 0 | 0 | X | 0 | 0 | |
| Case 4 | X | 1 | 1 | X | 1 | 1 | X | 1 | 1 | |
| | X | 1 | 1 | X | 1 | 0 | X | 0 | 1 | CHANGE D7/6 |
| | X | 1 | 1 | X | 0 | 1 | X | 0 | 0 | CHANGE D7 |
| | X | 1 | 1 | X | 0 | 0 | X | 0 | 0 | |

FIG. 4

| | (N-1) LINE DATA | | | (N) LINE DATA | | | WRITE DATA | | | |
|---|---|---|---|---|---|---|---|---|---|---|
| | D5 | D6 | D7 | D5 | D6 | D7 | D5 | D6 | D7 | |
| Case 1 | X | 0 | 0 | X | 1 | 1 | 1 | 1 | 1 | CHANGE D5 |
| | X | 0 | 0 | X | 1 | 0 | 1 | 1 | 1 | CHANGE D7/5 |
| | X | 0 | 0 | X | 0 | 1 | 1 | 1 | 0 | CHANGE D7/6/5 |
| | X | 0 | 0 | X | 0 | 0 | X | 0 | 0 | |
| Case 2 | X | 0 | 1 | X | 1 | 1 | 1 | 1 | 1 | CHANGE D5 |
| | X | 0 | 1 | X | 1 | 0 | 1 | 1 | 1 | CHANGE D7/5 |
| | X | 0 | 1 | X | 0 | 1 | X | 0 | 1 | |
| | X | 0 | 1 | X | 0 | 0 | 0 | 0 | 0 | CHANGE D5 |
| Case 3 | X | 1 | 0 | X | 1 | 1 | 1 | 1 | 1 | CHANGE D5 |
| | X | 1 | 0 | X | 1 | 0 | X | 1 | 0 | |
| | X | 1 | 0 | X | 0 | 1 | 0 | 0 | 0 | CHANGE D7/6/5 |
| | X | 1 | 0 | X | 0 | 0 | 0 | 0 | 0 | CHANGE D5 |
| Case 4 | X | 1 | 1 | X | 1 | 1 | X | 1 | 1 | |
| | X | 1 | 1 | X | 1 | 0 | 0 | 0 | 1 | CHANGE D7/6/5 |
| | X | 1 | 1 | X | 0 | 1 | 0 | 0 | 0 | CHANGE D7/5 |
| | X | 1 | 1 | X | 0 | 0 | 0 | 0 | 0 | CHANGE D5 |

FIG. 5

SOURCE DRIVER AND DISPLAY APPARATUS

CROSS-REFERENCE TO RELATED APPLICATION

This application is based upon and claims the benefit of priority from the prior Japanese Patent Application No. 2020-212025 filed on Dec. 22, 2020, the entire contents of which are incorporated herein by reference.

BACKGROUND

1. Technical Field

The present invention relates to a source driver and a display apparatus.

2. Description of the Related Art

An active matrix drive system is employed as a drive system for a display apparatus constituted of a display device such as a liquid crystal or an organic Electro Luminescence (EL). In the display apparatus of the active matrix drive system, a display panel is constituted of a semiconductor substrate where pixel portions and pixel switches are arranged in a matrix. A display is performed by controlling on/off of a pixel switch by a gate signal, supplying a drive signal corresponding to a video data signal to the pixel portion when the pixel switch is turned on, and controlling luminance of the respective pixel portions.

In recent years, as a display apparatus used for a TV or a monitor, demand for a display apparatus having a display panel with a high definition and a large screen size such as a 4K panel (pixel columns: 3840×RGB, pixel rows: 2160) and an 8K panel (having two times the pixel columns and the pixel rows of the 4K panel) has been increasing. In the display apparatus having such a large screen display panel, a high-speed processing is required for a driver that drives the display panel due to shortening of a horizontal scanning period in association with an increased screen size and an increased definition of the display panel.

Thus, there is proposed a display apparatus that performs so-called overdrive where a display panel is driven by a drive signal of a voltage value corresponding to the luminance higher than the luminance represented by a video signal (for example, JP-A-2009-15178).

SUMMARY

In a display apparatus having a large screen display panel, a wiring resistance (a load capacity) of a source line is large. Thus, a signal delay of a drive signal increases, and it sometimes occurs that a charging rate of each pixel portion does not reach a desired voltage value within a horizontal scanning period. Decrease of the charging rate of the pixel portion leads to no display of a luminance level corresponding to a video signal.

In particular, in a display apparatus such as an 8K TV having an ultrahigh-definition display panel, magnitude of the signal delay increases between a position on a source line where a distance from a source driver IC is relatively short (a source driver proximal end) and a position on the source line where the distance from the source driver IC is relatively long (a source driver distal end). Consequently, image quality is degraded because pixel charging rates differs depending on the distance from the source driver IC.

In the display apparatus where overdrive like the above-described prior art is employed, the pixel charging rate of the pixel portion is improved by, for example, comparing previous and next gradation digital data and supplying a target voltage and an excessive voltage to the pixel portion based on a gradation voltage difference.

However, because such so-called line overdrive is performed based on a comparison of the previous data and the next data, there is a problem that the difference in the pixel charging rate based on a load in a direction of the source line cannot be eliminated.

The present invention has been made in view of the above-described problem, and it is an object of the present invention to provide a display apparatus that can suppress the degradation of the image quality due to variation of the pixel charging rate in association with the signal delay in the direction of the source line.

According to the present invention, a source driver connected to a display panel including a plurality of source lines and a first to n th horizontal scanning lines (n is an integer equal to or more than 2), and a plurality of pixel portions disposed in a matrix at respective intersecting portions between the plurality of source lines and the first to n th horizontal scanning lines, the source driver receiving a video data signal including a plurality of data rows and generating a plurality of drive voltages based on the video data signal to apply the drive voltages to the respective plurality of pixel portions via the respective plurality of source lines, the source driver comprising; a latch unit that sequentially retrieves the video data signal for each data row corresponding to each of the first to n th horizontal scanning lines of the display panel; an overdrive arithmetic circuit that calculates an overdrive value of the drive voltages applied to the pixel portions on an N th line (N is an integer equal to or more than 2 and equal to or less than n), based on a comparison result of comparing the data row corresponding to the N th line among the first to n th horizontal scanning lines of the display panel with the data row corresponding to an (N−1) th line of the display panel and a distance to the N th line from the source driver; and a voltage output unit that generates the drive voltages applied to the pixel portions on the N th line based on the data row corresponding to the N th line and the overdrive value, the voltage output unit outputting the drive voltages to the plurality of source lines.

According to the present invention, A display apparatus comprising: a display panel including a plurality of source lines and a first to n th horizontal scanning lines (n is an integer equal to or more than 2) and a plurality of pixel portions and a plurality of pixel switches disposed in a matrix at respective intersecting portions between the plurality of source lines and the first to n th horizontal scanning lines: a gate driver that supplies a gate signal controlling the pixel switches to be turned on during a selection period corresponding to a pulse width to the first to n th horizontal scanning lines; a source driver that receives a video data signal including a plurality of data rows each of which is constituted of a series of a plurality of pixel data pieces, the source driver generating drive voltages based on the video data signal and applying the drive voltages to the respective plurality of pixel portions via the respective plurality of source lines; and a display controller that supplies the video data signal to the source driver, wherein the source driver includes: a latch unit that sequentially retrieves the video data signal for each data row corresponding to each of the first to n th horizontal scanning lines of the display panel; an overdrive arithmetic circuit that calculates an overdrive value of the drive voltages applied to the pixel portions on an N th line (N is an integer equal to or more than 2 and equal to or less than n), based on a comparison result of comparing the data row corresponding to the N th line among the first to n th horizontal scanning lines of the display panel with the data row corresponding to an (N−1) th line of the display panel and a distance to the N th line from the source driver; and a voltage output unit that generates the drive voltages applied to the pixel portions on the N th line based on the data row corresponding to the N th line and the overdrive value, the voltage output unit outputting the drive voltages to the plurality of source lines.

With the source driver according to the present invention, it is possible to suppress the degradation of the image quality due to the variation of the pixel charging rate in association with the signal delay in the direction of the source line.

BRIEF DESCRIPTION OF THE DRAWINGS

Features of the present invention will be described below with reference to the accompanying drawings.

FIG. 4 is a drawing illustrating an example of an arithmetic operation rule of the overdrive arithmetic operation at a source driver proximal end;

FIG. 5 is a drawing illustrating an example of an arithmetic operation rule of the overdrive arithmetic operation at a source driver distal end;

DETAILED DESCRIPTION

Preferred embodiments of the present invention will be described in detail below. The same reference numbers are given to substantially identical or equivalent parts in the description in the following embodiments and the accompanying drawings.

Figure 1:
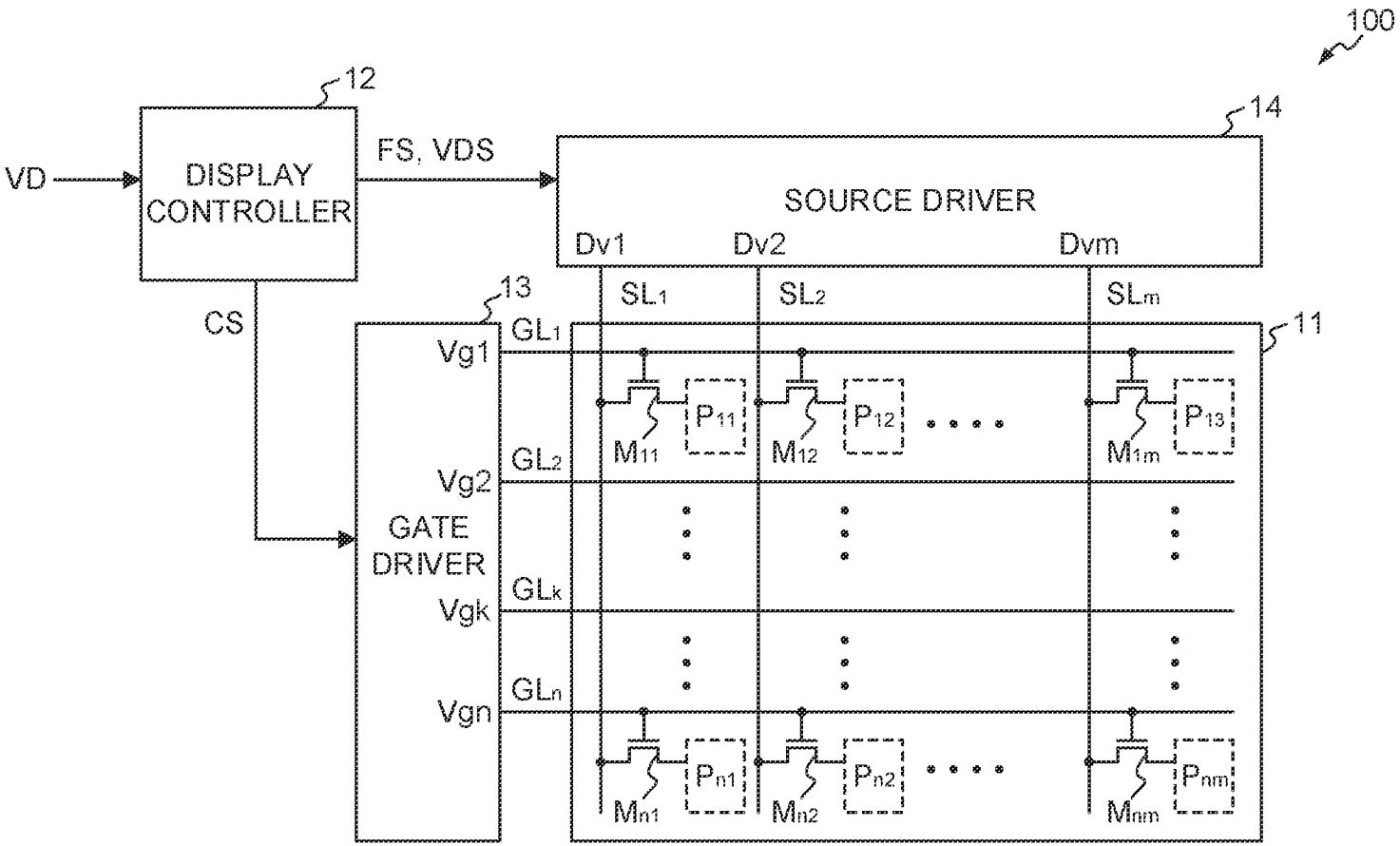
FIG. 1 is a block diagram illustrating a configuration of a display apparatus according to the present invention.

FIG. 1 is a block diagram illustrating a configuration of a display apparatus 100 according to the present invention. The display apparatus 100 is a liquid crystal display apparatus of an active matrix drive system. The display apparatus 100 includes a display panel 11, a display controller 12, a gate driver 13, and a source driver 14.

The display panel 11 is constituted of a semiconductor substrate where a plurality of pixel portions $P_{11}$ to $P_{nm}$ and a plurality of pixel switches $M_{11}$ to $M_{nm}$ (n, m: natural numbers equal to or more than 2) are arranged in a matrix. The display panel 11 has n gate lines GL1 to GLn that are scanning lines each of which extends in a horizontal direction and m source lines SL1 to SLm that are disposed to intersect with the n gate lines GL1 to GLn. The pixel portions $P_{11}$ to $P_{nm}$ and the pixel switches $M_{11}$ to $M_{nm}$ are disposed at intersecting portions of the gate lines GL1 to GLn and the source lines SL1 to SLm.

The pixel switches $M_{11}$ to $M_{nm}$ are controlled to be turned on or off corresponding to gate signals Vg1 to Vgn supplied from the gate driver 13.

The pixel portions $P_{11}$ to $P_{nm}$ receives a supply of a drive voltage (a gradation voltage) corresponding to video data from the source driver 14. Specifically, drive voltages Dv1 to Dvm are output to the source lines SL1 to SLm from the source driver 14, and the drive voltages Dv1 to Dvm are applied to the pixel portions $P_{11}$ to $P_{nm}$ when the respective pixel switches $M_{11}$ to $M_{nm}$ are turned on. This charges each pixel electrode of the pixel portions $P_{11}$ to $P_{nm}$ and controls luminance.

When the display apparatus 100 is the liquid crystal display apparatus, each of the pixel portions $P_{11}$ to $P_{nm}$ includes a liquid crystal sealed between a transparent electrode (not illustrated) and an opposite substrate that is provided opposed to the semiconductor substrate and on an entire surface of which one transparent electrode is formed. The display is performed by changing transmittance of the liquid crystal with respect to a backlight inside the display apparatus in response to an electric potential difference between the drive voltage (the gradation voltage) applied to the pixel portions $P_{11}$ to $P_{nm}$ and a voltage of the opposite substrate.

The display controller 12 generates a video data signal VDS that includes a series of pixel data pieces PD indicating a luminance level of each pixel in, for example, 256-steps of 8-bit luminance gradation, based on video data VD. The video data signal VDS is constituted as the video data signal serialized corresponding to the number of transmission paths for each predetermined number of source lines.

In the embodiment, the video data signal VDS for one frame is constituted by serially continuing n pixel data piece group, each of which is constituted of m pixel data pieces PD. Each of the n pixel data piece groups is a pixel data piece group constituted of the pixel data piece corresponding to the gradation voltage to be supplied to the pixels on one horizontal scanning line (namely, each of the gate lines GL1 to GLn), respectively. By an operation of the source driver 14, based on m×n pixel data pieces PD, the gradation voltages to be supplied to the n×m pixel portions (namely, the pixel portions $P_{11}$ to $P_{nm}$) are generated, and the drive voltages Dv1 to Dvm corresponding to the generated gradation voltages are applied via the source lines.

The display controller 12 generates a clock signal CLK of an embedded clock system where a clock pulse cycle (hereinafter referred to as a clock cycle) is constant. The display controller 12 supplies the clock signal CLK to the source driver 14 as a serial signal where the clock signal CLK is integrated with the video data signal VDS to perform a display control of the video data. The display controller 12 supplies a frame synchronizing signal FS indicating a timing for each one frame of the video data signal VDS to the source driver 14.

The display controller 12 supplies a gate timing signal GS to the gate driver 13.

The gate driver 13 supplies the gate signals Vg1 to Vgn to the gate lines GL1 to GLn based on the gate timing signal GS supplied from the display controller 12. By the supply of the gate signals Vg1 to Vgn, the pixel portions $P_{11}$ to $P_{nm}$ are selected for each pixel row. Then, by the drive voltages Dv1 to Dvm being applied to the selected pixel portions from the source driver 14, write of the gradation voltage to the pixel electrodes is performed.

The source driver 14 receives the supply of the frame synchronizing signal FS and the video data signal VDS from the display controller 12. Then, the source driver 14 generates a multi-value level gradation voltage signal corresponding to a gradation number indicated in the video data signal VDS and applies the drive voltages Dv1 to Dvm corresponding to the generated gradation voltage signal to the pixel portions $P_{11}$ to $P_{nm}$ via the source lines SL1 to SLm. The number of the source lines SL1 to SLm (namely, m) corresponds to the number of output channels of the source driver 14. The video data VDS and the clock signal CLK for m channels as the number of output channels are supplied to the source driver 14 as a serialized differential signal in one data period.

Figure 2:
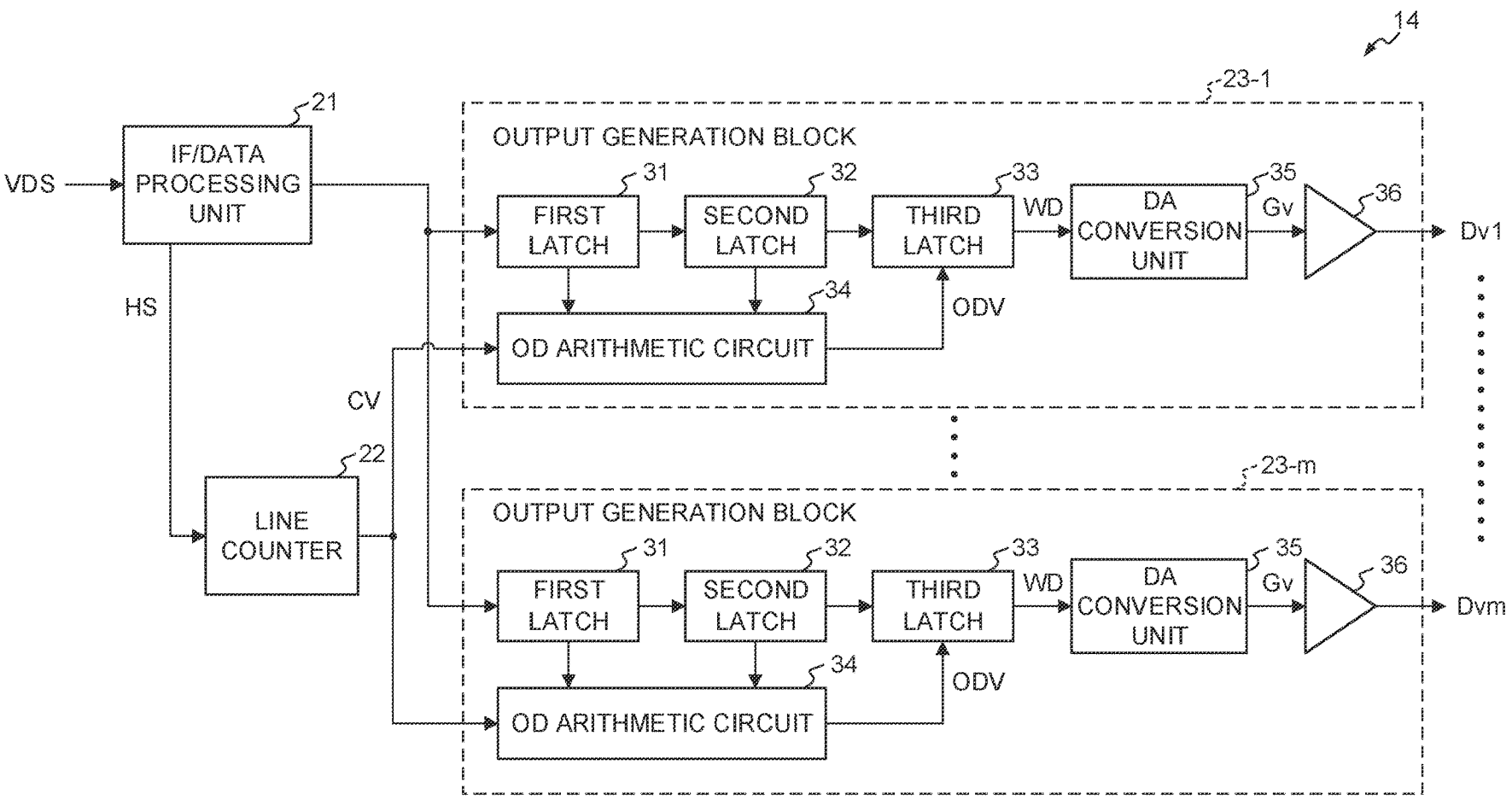
FIG. 2 is a block diagram illustrating an internal configuration of a source driver according to the present invention.

FIG. 2 is a block diagram illustrating an internal configuration of the source driver 14. The source driver 14 has an IF/data processing unit 21 and a line counter 22. The source driver 14 has output generation blocks 23-1 to **23-*m*** each corresponding to the output channels of 1 channel to m channels.

The IF/data processing unit 21 is an interface circuit that receives the supply of the video data signal VDS from the display controller 12. The IF/data processing unit 21 supplies a series of the pixel data pieces PD (hereinafter also referred to as a data row) included in the video data signal VDS to the output generation blocks 23-1 to **23-*m*** for each data corresponding to each output channel.

The IF/data processing unit 21 extracts a horizontal synchronization signal HS from the video data signal VDS to supply it to the line counter 22. The IF/data processing unit 21 resets a count value of the line counter 22 based on a vertical synchronization signal VS.

The line counter 22 performs count-up based on the horizontal synchronization signal HS supplied from the IF/data processing unit 21 to supply a count value CV to the output generation blocks 23-1 to **23-*m*. That is, the line counter 22 counts the data row included in the video data signal VDS for each one line of data and generates the count value CV indicating what number of line the data is located (namely, what number of gate lines the data corresponds to) to supply it to the output generation blocks 23-1 to 23-*m***.

The output generation block 23-1 includes a first latch 31, a second latch 32, a third latch 33, an OD arithmetic circuit 34, a DA conversion unit 35, and an operational amplifier 36. The other output generation blocks (namely, the output generation blocks 23-2 to **23-*m***) have the similar configuration.

The first latch 31, the second latch 32, and the third latch 33 are a latch unit that sequentially retrieves the series of the pixel data pieces PD included in the video data signal VDS for each data row corresponding to each of the n gate lines. Each of the first latch 31, the second latch 32, and the third latch 33 constitutes a plurality of stages of latches connected in cascade. The first latch 31, the second latch 32, and the third latch 33 retrieve the data in response to a clock timing of the clock signal CLK and output the data to the next stage at the next clock timing.

The first latch 31 retrieves the pixel data piece PD output from the IF/data processing unit 21. The first latch 31 outputs the retrieved pixel data piece PD and supplies it to the second latch 32 and also supplies it to the OD arithmetic circuit 34.

The second latch 32 retrieves the pixel data piece PD output from the first latch 31. The second latch 32 outputs the retrieved pixel data piece PD and supplies it to the third latch 33 and also supplies it to the OD arithmetic circuit 34.

The third latch 33 retrieves the pixel data piece PD output from the second latch 32. The third latch 33 receives the supply of an overdrive adjustment value ODV from the OD arithmetic circuit 34. The third latch 33 performs an overdrive adjustment on the retrieved pixel data piece PD based on the overdrive adjustment value ODV. The third latch 33 supplies the adjusted data to the DA conversion unit 35 as write data WD.

The OD arithmetic circuit 34 is an arithmetic circuit calculating the overdrive adjustment value ODV for performing so-called overdrive that drives the source line with the drive voltage corresponding to the gradation voltage signal having a voltage value higher than that of the gradation voltage signal corresponding to the pixel data piece PD to be written. The OD arithmetic circuit 34 performs an overdrive arithmetic operation for calculating the overdrive adjustment value ODV based on the pixel data piece PD output from the first latch 31 and the pixel data piece PD output from the second latch 32.

The DA conversion unit 35 receives the supply of overdrive-performed write data WD from the third latch 33 and generates a gradation voltage Gv obtained by level-shifting and digital-to-analog conversion of the write data WD.

The operational amplifier 36 amplifies the gradation voltage Gv generated by the DA conversion unit 35 and outputs it to the source lines SL1 to SLm as the drive voltages Dv1 to Dvm.

Figure 3:
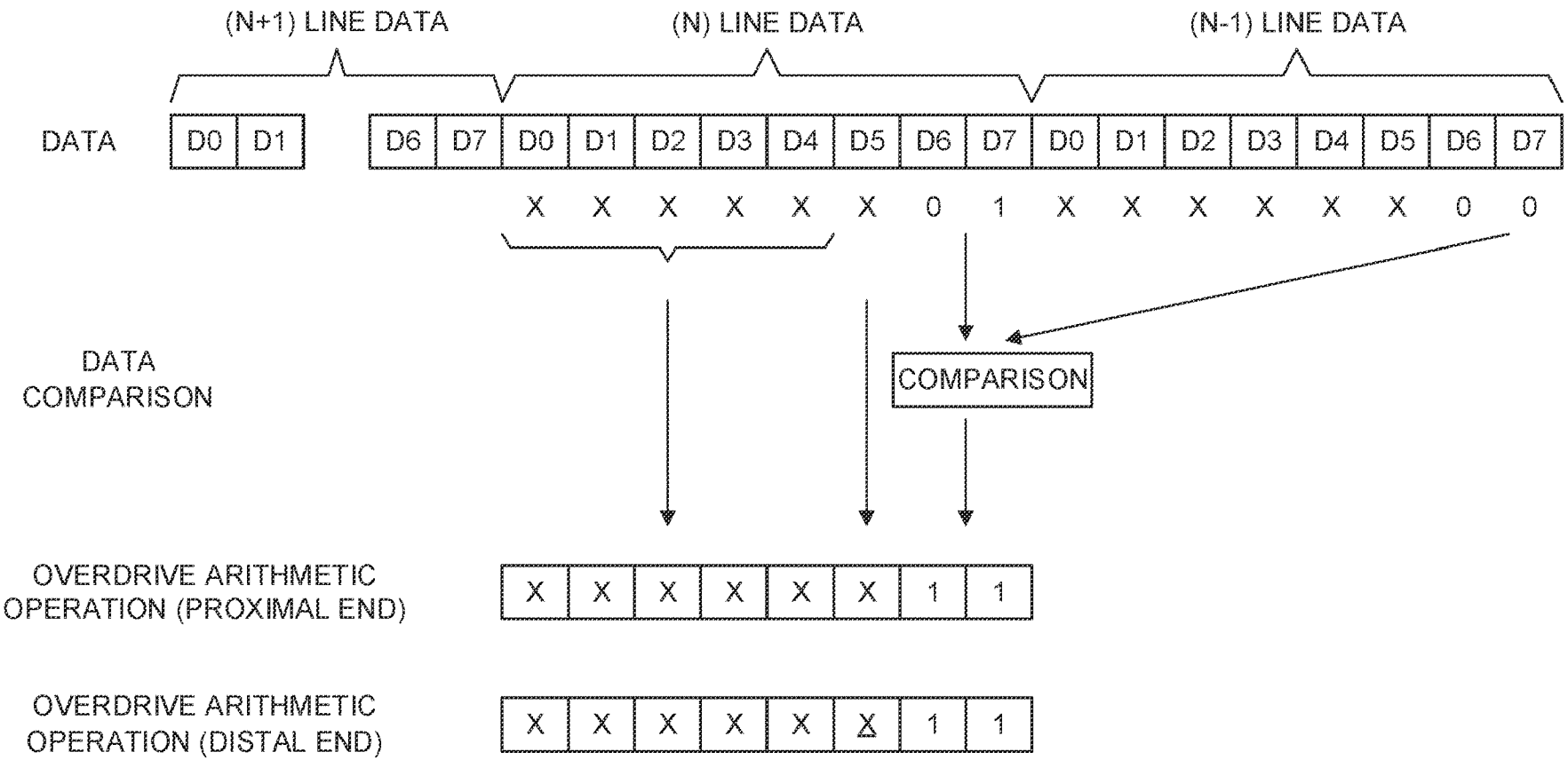
FIG. 3 is a drawing schematically illustrating an overdrive arithmetic operation.

FIG. 3 is a drawing schematically illustrating the arithmetic operation (the overdrive arithmetic operation) for calculating the overdrive adjustment value ODV by the OD arithmetic circuit 34 of the embodiment. Here, a case where one line of the pixel data piece PD is constituted of 8-bit (one byte) data is shown as an example.

Each of the first latch 31, the second latch 32, and the third latch 33 retrieve the pixel data piece PD at one clock timing of the clock signal CLK and output the pixel data piece PD at the next clock timing. Thus, for example, the first latch 31 outputs the data of an (N) line at the timing when the second latch 32 outputs the data of an (N−1) line (N is an integer equal to or more than 2). Accordingly, the data of the (N) line is supplied to the OD arithmetic circuit 34 from the first latch 31 at the timing when the data of the (N−1) line is supplied from the second latch 32.

The OD arithmetic circuit 34 compares the data of the (N) line output from the first latch 31 with the data of the (N−1) line output from the second latch 32 and calculates the overdrive adjustment value ODV based on a comparison result. That is, the data row corresponding to each line is constituted of data values of a predetermined number of bits (8 bits in the embodiment) representing the luminance levels of the pixels. The OD arithmetic circuit 34 compares the data values of each bit digit and calculate the overdrive adjustment value ODV based on a difference of the data values.

In the embodiment, the OD arithmetic circuit 34 compares the data of upper 2 bits of the 8 bits (namely, D6 and D7 of DO to D7). For example, when the upper 2 bits of the data of the (N−1) line are "0" and "0," and the upper 2 bits of the data of the (N) line are "0" and "1," the data of an uppermost bit is different. Thus, the OD arithmetic circuit 34 calculates the overdrive adjustment value ODV such that the upper 2 bits of the data of the (N) line are set to "1" and "1."

The OD arithmetic circuit 34 of the embodiment changes handling of the overdrive adjustment for the data D5, which is the third bit from the upper order, corresponding to a distance from the source driver 14. The overdrive adjustment is not performed for the write data (namely, the data corresponding to the gradation voltage signal to be supplied to the pixel portion) corresponding to the pixel portion with a short distance from the source driver 14 and the data of the (N) line is set as the write data without change. On the other hand, the overdrive adjustment is performed for the write data corresponding to the pixel portion with the long distance from the source driver 14. In the following description, an area in a short distance from the source driver 14 is referred to as "a source driver proximal end," and the area in a long distance from the source driver 14 is referred to as "a source driver distal end."

The OD arithmetic circuit 34 of the embodiment does not perform the overdrive adjustment for the data of lower 5 bits of the 8 bits (namely, DO to D4). Thus, for the data DO to the data D4, the data values of the (N) line output from the first latch 31 becomes the data values of the write data WD without change.

FIGS. 4 and 5 are drawings illustrating examples of arithmetic operation rule of the overdrive arithmetic operation of the embodiment. FIG. 4 illustrates the example of the arithmetic operation rule for the write data WD at the source driver proximal end. FIG. 5 illustrates the example of the arithmetic operation rule for the write data WD at the source driver distal end.

As shown in FIG. 4, at the source driver proximal end, the overdrive adjustment is not performed for the data DO to the data D5, and the overdrive adjustment is performed for the data D6 and the data D7 of the upper 2 bits based on the comparison between the data of the (N−1) line and the data of the (N) line.

For example, when the upper 2 bits of the data of the (N−1) line are "0" and "0" (case 1), and the upper 2 bits of the data of the (N) line are "1" and "1," "1" and "1" are set as the upper 2 bits of the write data WD without change. When the upper 2 bits of the data of the (N) line are "0" and "0," "0" and "0" are set as the upper 2 bits of the write data WD without change. On the other hand, when the upper 2 bits of the data of the (N) line are "1" and "0," the overdrive adjustment value ODV is calculated such that the upper 2 bits of the write data WD becomes "1" and "1" by changing the data D7. When the upper 2 bits of the data of the (N) line are "0" and "1," the overdrive adjustment value ODV is calculated such that the upper 2 bits of the write data WD becomes "1" and "0" by changing the data D7 and the data D6.

When the upper 2 bits of the data of the (N−1) line are "0" and "1" (case 2), and the upper 2 bits of the data of the (N) line are "1" and "1," "1" and "1" are set as the upper 2 bits of the write data WD without change. When the upper 2 bits of the data of the (N) line are "0" and "1," "0" and "1" are set as the upper 2 bits of the write data WD without change. When the upper 2 bits of the data of the (N) line are "0" and "0," "0" and "0" are set as the upper 2 bits of the write data WD without change. On the other hand, when the upper 2 bits of the data of the (N) line are "1" and "0," the overdrive adjustment value ODV is calculated such that the upper 2 bits of the write data WD becomes "1" and "1" by changing the data D7.

When the upper 2 bits of the data of the (N−1) line are "1" and "0" (case 3), and the upper 2 bits of the data of the (N) line are "1" and "1," "1" and "1" are set as the upper 2 bits of the write data WD without change. When the upper 2 bits of the data of the (N) line are "1" and "0," "1" and "0" are set as the upper 2 bits of the write data WD without change. When the upper 2 bits of the data of the (N) line are "0" and "0," "0" and "0" are set as the upper 2 bits of the write data WD without change. On the other hand, when the upper 2 bits of the data of the (N) line are "0" and "1," the overdrive adjustment value ODV is calculated such that the upper 2 bits of the write data WD becomes "0" and "0" by changing the data D7 and the data D6.

When the upper 2 bits of the data of the (N−1) line are "1" and "1" (case 4), and the upper 2 bits of the data of the (N) line are "1" and "1," "1" and "1" are set as the upper 2 bits of the write data WD without change. When the upper 2 bits of the data of the (N) line are "0" and "0," "0" and "0" are set as the upper 2 bits of the write data WD without change. On the other hand, when the upper 2 bits of the data of the (N) line are "1" and "0," the overdrive adjustment value ODV is calculated such that the upper 2 bits of the write data WD becomes "0" and "1" by changing the data D7 and the data D6. When the upper 2 bits of the data of the (N) line are "0" and "1," the overdrive adjustment value ODV is calculated such that the upper 2 bits of the write data WD becomes "0" and "0" by changing the data D7.

As shown in FIG. 5, at the source driver distal end, in addition to the upper 2 bits of the data D6 and the data D7, the overdrive adjustment is performed for the data D5.

For example, when the upper 2 bits of the data of the (N−1) line are "0" and "0" (case 1), and the upper 2 bits of the data of the (N) line are "1" and "1," the overdrive adjustment value ODV is calculated such that the upper 3 bits of the write data WD becomes "1," "1," and "1" by changing the data D5. When the upper 2 bits of the data of the (N) line are "1" and "0," the overdrive adjustment value ODV is calculated such that the upper 3 bits of the write data WD becomes "1," "1," and "1" by changing the data D5 and the data D7. When the upper 2 bits of the data of the (N) line are "0" and "1," the overdrive adjustment value ODV is calculated such that the upper 3 bits of the write data WD becomes "1," "1," and "0" by changing the data D5, the data D6, and the data D7. On the other hand, when the upper 2 bits of the data of the (N) line are "0" and "0," "0" and "0" are set as the upper 2 bits of the write data WD without change.

When the upper 2 bits of the data of the (N−1) line are "0" and "1" (case 2), and the upper 2 bits of the data of the (N) line are "1" and "1," the overdrive adjustment value ODV is calculated such that the upper 3 bits of the write data WD becomes "1," "1," and "1" by changing the data D5. When the upper 2 bits of the data of the (N) line are "1" and "0," the overdrive adjustment value ODV is calculated such that the upper 3 bits of the write data WD becomes "1," "1," and "1" by changing the data D5 and the D7. When the upper 2 bits of the data of the (N) line are "0" and "0," the overdrive adjustment value ODV is calculated such that the upper 3 bits of the write data WD becomes "0," "0," and "0" by changing the data D5. On the other hand, when the upper 2 bits of the data of the (N) line are "0" and "1," "0" and "1" are set as the upper 2 bits of the write data WD without change.

When the upper 2 bits of the data of the (N−1) line are "1" and "0" (case 3), and the upper 2 bits of the data of the (N) line are "1" and "1," the overdrive adjustment value ODV is calculated such that the upper 3 bits of the write data WD becomes "1," "1," and "1" by changing the data D5. When the upper 2 bits of the data of the (N) line are "0" and "1," the overdrive adjustment value ODV is calculated such that the upper 3 bits of the write data WD becomes "0," "0," and "0" by changing the data D5, the data D6, and the data D7. When the upper 2 bits of the data of the (N) line are "0" and "0," the overdrive adjustment value ODV is calculated such that the upper 3 bits of the write data WD becomes "0," "0," and "0" by changing the data D5. On the other hand, when the upper 2 bits of the data of the (N) line are "1" and "0," "1" and "0" are set as the upper 2 bits of the write data WD without change.

When the upper 2 bits of the data of the (N−1) line are "1" and "1" (case 4), and the upper 2 bits of the data of the (N) line are "1" and "1," "1" and "1" are set as the upper 2 bits of the write data WD without change. On the other hand, when the upper 2 bits of the data of the (N) line are "1" and "0," the overdrive adjustment value ODV is calculated such that the upper 3 bits of the write data WD becomes "0," "0," and "1" by changing the data D5, the data D6, and the data D7. When the upper 2 bits of the data of the (N) line are "0" and "1," the overdrive adjustment value ODV is calculated such that the upper 3 bits of the write data WD becomes "0," "0," and "0" by changing the data D5 and the data D7. When the upper 2 bits of the data of the (N) line are "0" and "0," the overdrive adjustment value ODV is calculated such that the upper 3 bits of the write data WD becomes "0," "0," and "0" by changing the data D5.

Thus, the OD arithmetic circuit 34 of the embodiment calculates the overdrive adjustment value ODV based on the difference of the data values between the data of the line ((N) line) to be written and the data of the line ((N−1) line) immediately before that. This allows performing the overdrive based on the difference in the data for each line.

For example, when the electric potential difference between the gradation voltage of the (N−1) line and the gradation voltage of the (N) line is large, writing the voltage of the (N) line with no change without performing the overdrive makes it impossible to reach the target voltage due to shortage of charging when a panel load is large. However, it is possible to cause the write voltage of the (N) line to reach the target voltage by performing the overdrive based on the difference between the data of the (N−1) line and the data of the (N) line in this way.

Furthermore, the OD arithmetic circuit 34 of the embodiment, in addition to calculating the overdrive adjustment value ODV based on the data comparison, weights the overdrive adjustment value ODV such that an overdrive amount of the drive voltage signal at the source driver distal end becomes larger than that at the source driver proximal end. Thus, the overdrive adjustment corresponding to the signal delay in the direction of the source line is performed.

Figure 6:
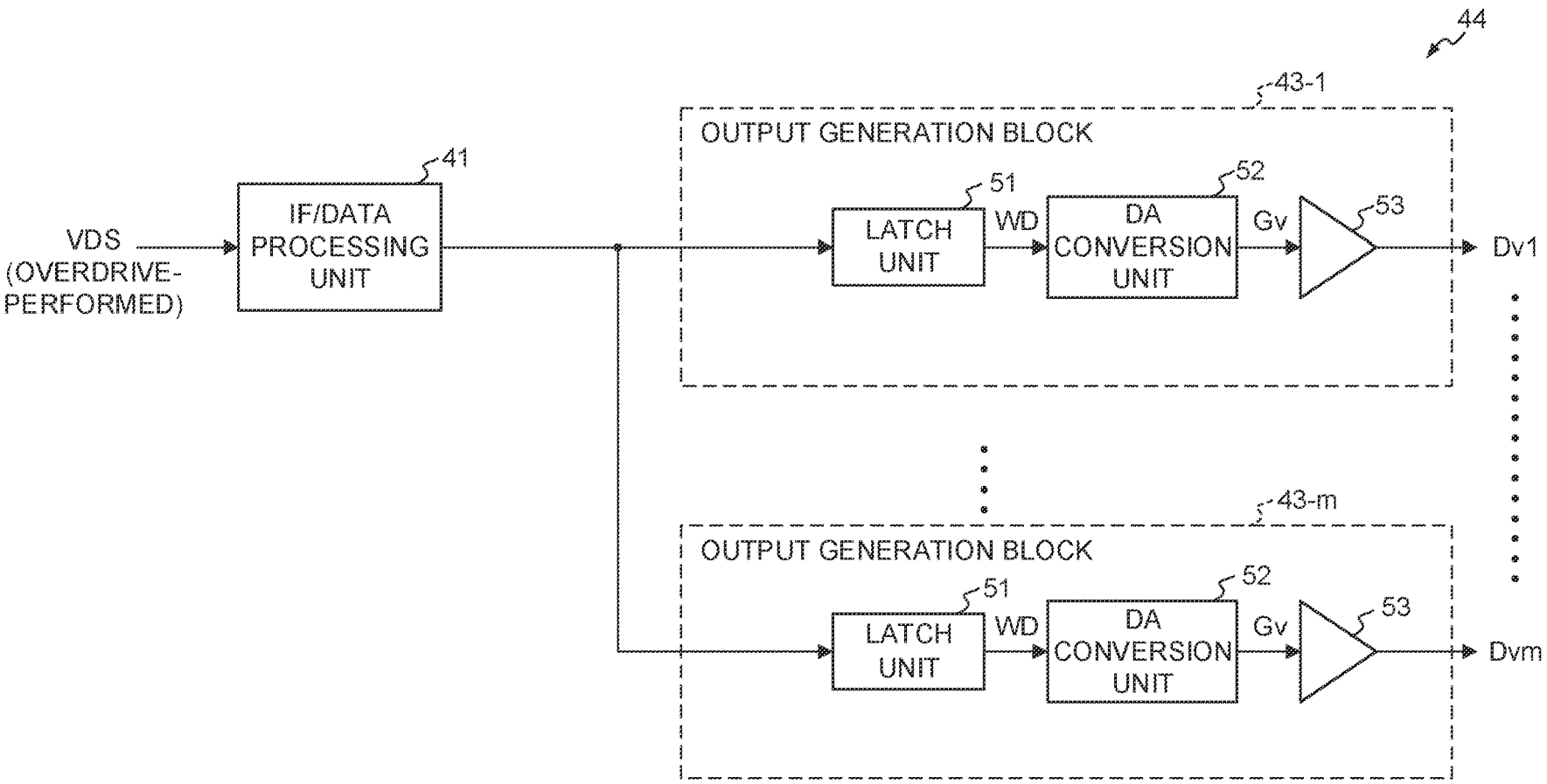
FIG. 6 is a block diagram illustrating an internal configuration of a source driver of a comparative example.

FIG. 6 is, unlike the embodiment, a block diagram illustrating a configuration of a source driver 44 of a comparative example where weighting the overdrive adjustment value corresponding to the signal delay in the direction of the source line is not performed.

The source driver 44 of the comparative example has an IF/data processing unit 41, and output generation blocks 43-1 to **43-*m*** corresponding to the output channels of 1 channel to m channels, respectively.

The IF/data processing unit 41 of the comparative example receives the supply of the video data signal VDS in a state where the overdrive adjustment is performed based on the data comparison for each line from the display controller 12. The IF/data processing unit 41 supplies the series of the pixel data pieces PD (the data row) included in the video data signal VDS to the output generation blocks 43-1 to **43-*m*** for each data corresponding to each output channel.

The output generation blocks 43-1 to **43-*m* includes a latch unit 51, a DA conversion unit 52, and an operational amplifier 53**.

The latch unit 51 retrieves the pixel data piece PD output from the IF/data processing unit 41. The latch unit 51 outputs the retrieved pixel data piece PD as the write data WD to supply it to the DA conversion unit 52.

The DA conversion unit 52 receives the supply of the write data WD from the latch unit 51 and generates the gradation voltage Gv obtained by level-shifting and digital-to analog conversion of the write data WD. The operational amplifier 53 amplifies the gradation voltage Gv generated by the DA conversion unit 52 and outputs it to the source lines SL1 to SLm as the drive voltages Dv1 to Dvm.

Figure 7:
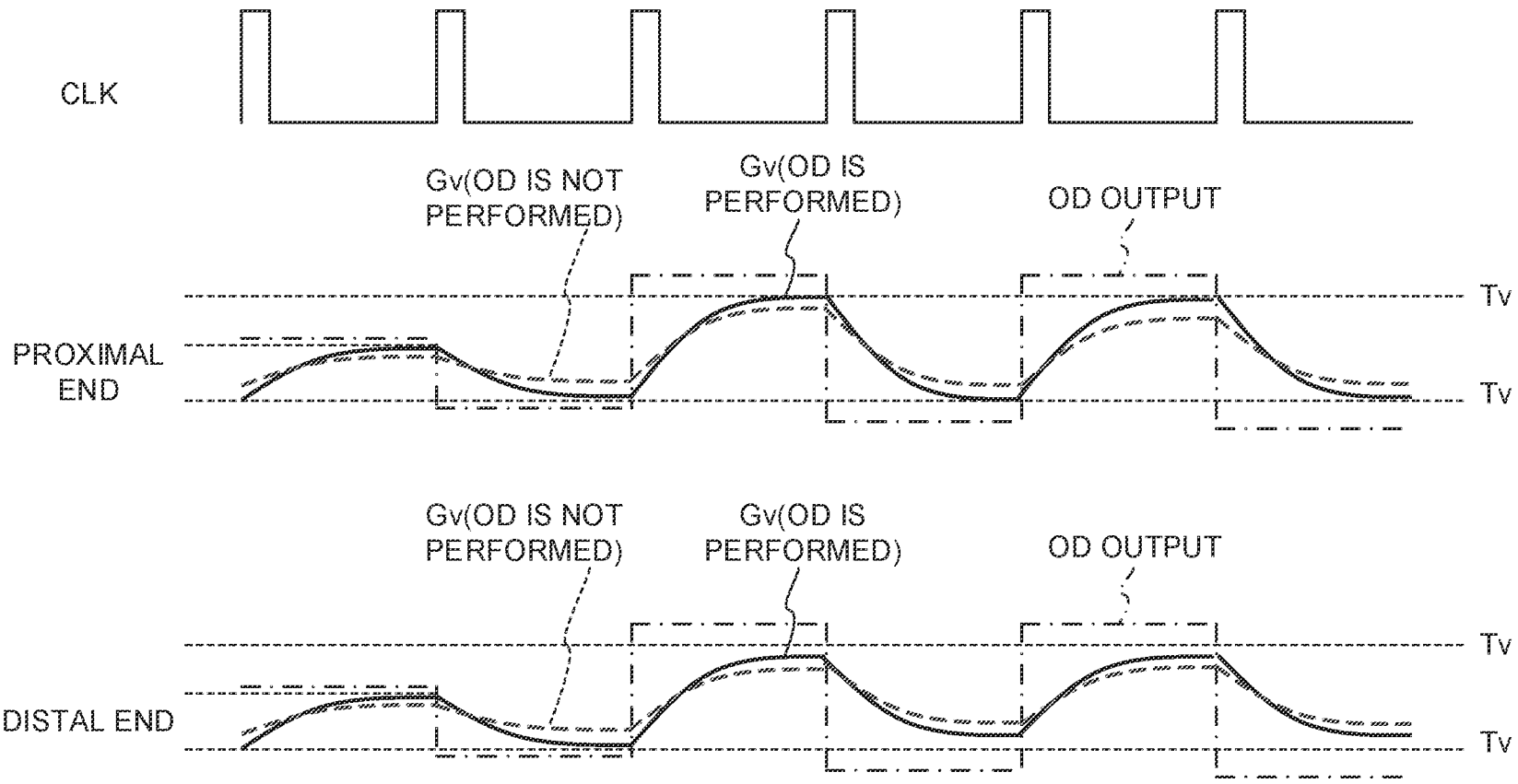
FIG. 7 is a drawing illustrating a change of a voltage waveform of a drive voltage in the comparative example.

FIG. 7 is a drawing illustrating the voltage waveform of the drive voltages Dv1 to Dvm output from the source driver 44 of the comparative example. An upper row indicates a signal waveform of the clock signal CLK, a middle row indicates the drive voltage applied to the source driver proximal end, and a lower row indicates the drive voltage applied to the source driver distal end. Dashed lines in the middle row and the lower row indicate the waveforms of the drive voltages applied to the pixel portions when it is assumed that there is no overdrive. One-dot-chain lines indicate a waveform of an overdrive output, which is output from the operational amplifier 53. Solid lines in the middle row and the lower row indicate the waveforms of the drive voltages applied to the pixel portions when the overdrive is performed.

In the pixel portions at the source driver proximal end, the voltage value of the drive voltage signal Dv does not reach the target voltage Tv (namely, the voltage value of the target drive voltage) without any overdrive. However, performing the overdrive allows it to reach the voltage level of the target voltage Tv.

On the other hand, in the pixel portions at the source driver distal end, the voltage level of the drive voltage decreases due to a capacity and the wiring resistance of the source line. Consequently, even if the same degree of overdrive as that at the source driver proximal end is performed, the voltage value of the drive voltage signal Dv after the overdrive has been performed does not reach the voltage level of the target voltage Tv.

Figure 8:
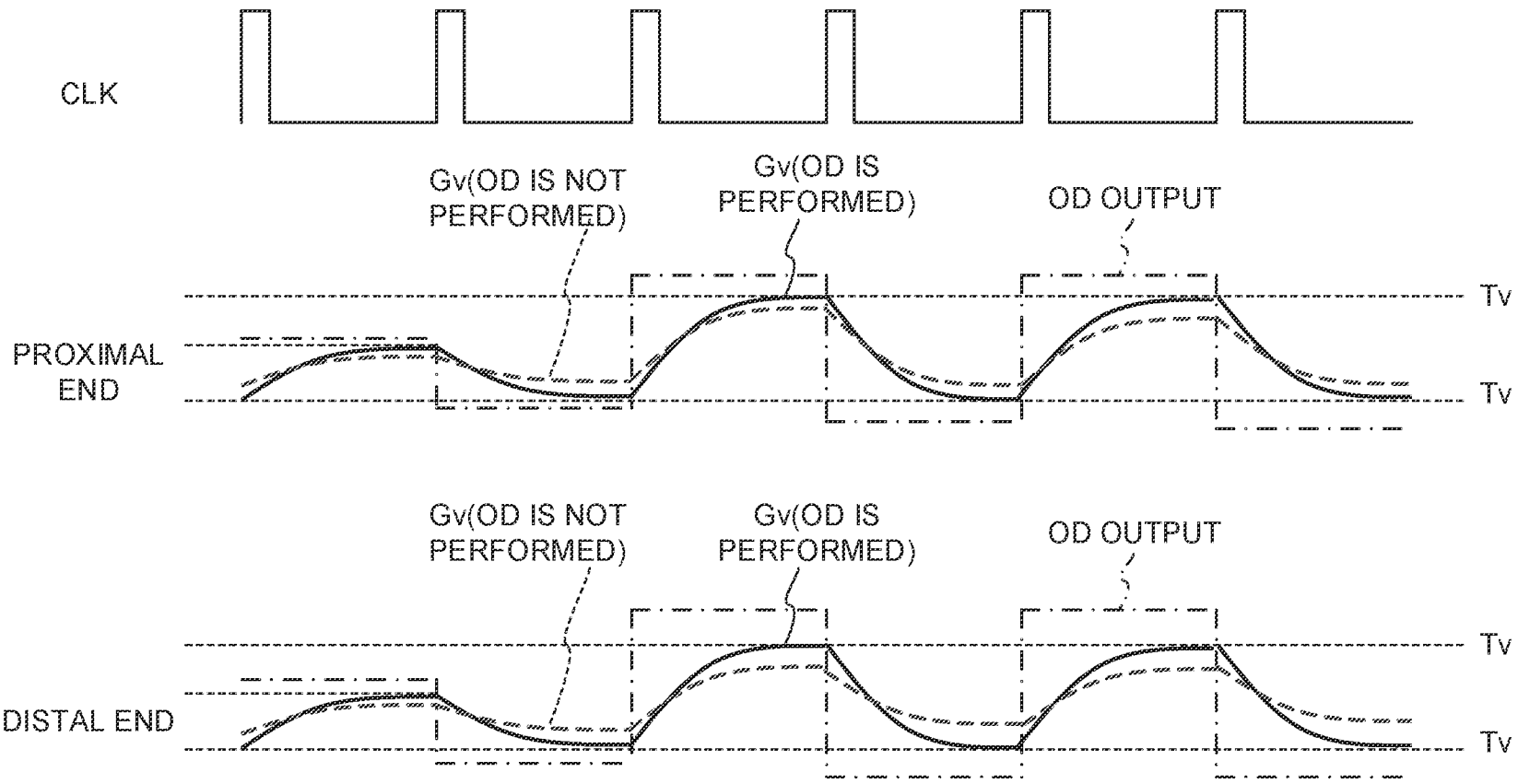
FIG. 8 is a drawing illustrating a change of a voltage waveform of a drive voltage in an embodiment.

FIG. 8 is a drawing illustrating the voltage waveforms of the drive voltages Dv1 to Dvm output from the source driver 14 of the embodiment.

In the source driver 14 of the embodiment, the overdrive adjustment value is weighted such that the overdrive amount of the drive voltage relative to the pixel portions at the source driver distal end becomes larger than the overdrive amount of the drive voltage relative to the pixel portions at the source driver proximal end. Thus, as seen from the comparison between the middle row and the lower row in FIG. 8, the overdrive output at the source driver distal end is larger compared to that at the source driver proximal end. Consequently, the drive voltage signal Dv after the overdrive has been performed, which is applied to the pixel portions at the source driver distal end, also can reach the voltage level of the target Tv, similar to the source driver proximal end. Therefore, it is possible to apply the drive voltage signal Dv of the target voltage level relative to the pixel portions at the source driver distal end and sufficiently charge the gradation voltage.

As described above, with the source driver 14 of the embodiment, it is possible to suppress degradation of image quality due to variation of a pixel charging rate in association with the signal delay in the direction of the source line.

The present invention is not limited to the above-described embodiment. For example, in the above-described embodiment, in addition to calculating the overdrive adjustment value based on the comparison of the data rows for each line, the case where the overdrive adjustment corresponds to the distance in the direction of the source line (namely, the distance to each line-shaped pixel portion from the source driver) has been described. However, the configuration may be such that the overdrive based on the comparison of the data rows for each line (namely, the line overdrive) is not performed, and only the overdrive corresponding to the distance in the direction of the source line is performed.

The overdrive arithmetic operation in the above-described embodiment is one example, and the overdrive arithmetic operation may be performed based on the other arithmetic operation rule.

What is claimed is:

1. A source driver connected to a display panel including a plurality of source lines and a first to n th horizontal scanning lines (n is an integer equal to or more than 2), and a plurality of pixel portions disposed in a matrix at respective intersecting portions between the plurality of source lines and the first to n th horizontal scanning lines, the source driver receiving a video data signal including a plurality of data rows and generating a plurality of drive voltages based on the video data signal to apply the drive voltages to the respective plurality of pixel portions via the respective plurality of source lines, the source driver comprising;

a latch unit that sequentially retrieves the video data signal for each data row corresponding to each of the first to n th horizontal scanning lines of the display panel;

an overdrive arithmetic circuit that calculates an overdrive value of the drive voltages applied to the pixel portions on an N th line (N is an integer equal to or more than 2 and equal to or less than n), based on a comparison result of comparing the data row corresponding to the N th line among the first to n th horizontal scanning lines of the display panel with the data row corresponding to an (N−1) th line of the display panel and a distance to the N th line from the source driver; and a voltage output unit that generates the drive voltages applied to the pixel portions on the N th line based on the data row corresponding to the N th line and the overdrive value, the voltage output unit outputting the drive voltages to the plurality of source lines.

2. The source driver according to claim 1, wherein the overdrive arithmetic circuit calculates the overdrive value such that the drive voltage output from the voltage output unit varies corresponding to a length of the source line to the pixel portion where the drive voltage is supplied from the source driver.

3. The source driver according to claim 1, wherein the latch unit includes a plurality of stages of latches connected in cascade, and the overdrive arithmetic circuit calculates the overdrive value based on a comparison result of comparing the data row output from one latch constituting the plurality of stages of latches with the data row output from another latch positioned at a next stage of the one latch.

4. The source driver according to claim 1, further comprising a line counter that counts a line count of the horizontal scanning lines corresponding to the data row retrieved by the latch unit among the plurality of data rows based on a horizontal synchronization signal included in the video data signal, wherein the overdrive arithmetic circuit calculates the overdrive value based on a counted value of the line counter and the comparison result of the data rows.

5. The source driver according to claim 1, wherein each of the plurality of data rows is constituted of a series of pixel data pieces that represents a luminance level of each pixel as data values of a predetermined number of bits, and the overdrive arithmetic circuit calculates the overdrive value based on a difference between the data values of the data row corresponding to the N th line and the data values of the data row corresponding to the (N−1) th line.

6. A display apparatus comprising:

a display panel including a plurality of source lines and a first to n th horizontal scanning lines (n is an integer equal to or more than 2) and a plurality of pixel portions and a plurality of pixel switches disposed in a matrix at respective intersecting portions between the plurality of source lines and the first to n th horizontal scanning lines:

a gate driver that supplies a gate signal controlling the pixel switches to be turned on during a selection period corresponding to a pulse width to the first to n th horizontal scanning lines;

a source driver that receives a video data signal including a plurality of data rows each of which is constituted of a series of a plurality of pixel data pieces, the source driver generating drive voltages based on the video data signal and applying the drive voltages to the respective plurality of pixel portions via the respective plurality of source lines; and a display controller that supplies the video data signal to the source driver, wherein the source driver includes:

a latch unit that sequentially retrieves the video data signal for each data row corresponding to each of the first to n th horizontal scanning lines of the display panel;

an overdrive arithmetic circuit that calculates an overdrive value of the drive voltages applied to the pixel portions on an N th line (N is an integer equal to or more than 2 and equal to or less than n), based on a comparison result of comparing the data row corresponding to the N th line among the first to n th horizontal scanning lines of the display panel with the data row corresponding to an (N−1) th line of the display panel and a distance to the N th line from the source driver; and a voltage output unit that generates the drive voltages applied to the pixel portions on the N th line based on the data row corresponding to the N th line and the overdrive value, the voltage output unit outputting the drive voltages to the plurality of source lines.

* * * * *